US011623268B2

(12) United States Patent
Ferraiolo

(10) Patent No.: US 11,623,268 B2
(45) Date of Patent: Apr. 11, 2023

(54) MACHINE AND METHOD FOR MANUFACTURING A REINFORCED NET AND REINFORCED NET

(71) Applicant: OFFICINE MACCAFERRI S.P.A., Zola Predosa (IT)

(72) Inventor: Francesco Ferraiolo, Ca ' de' Fabbri (IT)

(73) Assignee: OFFICINE MACCAFERRI S.P.A., Zola Predosa (IT)

( * ) Notice: Subject to any disclaimer, the term of this patent is extended or adjusted under 35 U.S.C. 154(b) by 211 days.

(21) Appl. No.: 16/478,677

(22) PCT Filed: Feb. 9, 2017

(86) PCT No.: PCT/IB2017/050700

§ 371 (c)(1),
(2) Date: Jul. 17, 2019

(87) PCT Pub. No.: WO2018/146516

PCT Pub. Date: Aug. 16, 2018

(65) Prior Publication Data

US 2019/0388957 A1 Dec. 26, 2019

(51) Int. Cl.
*B21F 27/06* (2006.01)

(52) U.S. Cl.
CPC ..... *B21F 27/06* (2013.01)

(58) Field of Classification Search
CPC .. B21F 3/00; B21F 15/04; B21F 15/06; B21F 27/00; B21F 27/005; B21F 27/02; B21F 27/06; B21F 23/00; B21F 27/08
(Continued)

(56) References Cited

U.S. PATENT DOCUMENTS 433,633 A 8/1890 Scarles
441,437 A 11/1890 Morris
(Continued)

FOREIGN PATENT DOCUMENTS

AU 2005202308 A1 6/2005
CN 2775137 Y 4/2006
(Continued)

OTHER PUBLICATIONS

Translation JP57-28645A; Feb. 1982 Hoshiai et al.*
(Continued)

*Primary Examiner* — Edward T Tolan
(74) *Attorney, Agent, or Firm* — Flynn Thiel, P.C.

(57) ABSTRACT

A machine for manufacturing a reinforced net with hexagonal meshes including a plurality of permanently deformable wires, a reinforcing element, and a mechanism for the reciprocal coiling of first wires and second wires in twos. The mechanism has passages for the reinforcing elements, and a feed system for: the first wires, fed in from a plurality of containers mounted on board the machine and provided internally with a predetermined length of the first wires; for part of the second wires, fed in alternately with the first wires, so as to be interwoven therewith in twos in the coiling mechanism; and for the reinforcing elements, fed into the machine. For all the reinforcing elements, a wire receptacle is provided for one of the second wires, the wire receptacle being rotatable around the reinforcing element.

13 Claims, 5 Drawing Sheets

(58) Field of Classification Search
USPC ..... 140/6, 10, 19, 107
See application file for complete search history.

(56) References Cited

U.S. PATENT DOCUMENTS

| | | | | | |
|---|---|---|---|---|---|
| 483,969 | A | | 10/1892 | Scarles | |
| 529,093 | A | * | 11/1894 | Wright | B21F 27/06 140/6 |
| 768,102 | A | | 8/1904 | Whittington | |
| 902,198 | A | * | 10/1908 | Barlow | B21F 27/06 140/6 |
| 976,946 | A | * | 11/1910 | Storey | B21F 27/06 87/24 |
| 1,119,759 | A | | 12/1914 | Knowelden | |
| 1,195,688 | A | | 8/1916 | Kilmer | |
| 1,401,557 | A | | 12/1921 | Riviere et al. | |
| 1,859,831 | A | | 5/1932 | Land | |
| 1,868,968 | A | | 7/1932 | Casablancas | |
| 2,929,239 | A | * | 3/1960 | Dahlhauser | E04F 13/04 52/454 |
| 3,084,720 | A | * | 4/1963 | Yaeger | B21F 17/00 140/10 |
| 4,081,159 | A | * | 3/1978 | Baldwin | B21F 27/06 140/24 |
| 9,016,328 | B2 | | 4/2015 | Ferraiolo | |
| 2007/0079985 | A1 | | 4/2007 | Ferraiolo | |
| 2010/0224736 | A1 | | 9/2010 | Chen et al. | |
| 2012/0205496 | A1 | | 8/2012 | Ferraiolo | |
| 2012/0261075 | A1 | | 10/2012 | Ferraiolo | |

FOREIGN PATENT DOCUMENTS

| | | | | | |
|---|---|---|---|---|---|
| CN | 101824826 | A | | 9/2010 | |
| CN | 102481617 | A | | 5/2012 | |
| CN | 102656304 | A | | 9/2012 | |
| DE | 339688 | C | | 8/1921 | |
| DE | 529129 | C | * | 2/1934 | B21F 27/06 |
| EA | 026513 | B1 | | 4/2017 | |
| FR | 761904 | | | 3/1934 | |
| GB | 191205977 | A | | 7/1912 | |
| GB | 120308 | | | 11/1918 | |
| GB | 113968 | A | | 4/1919 | |
| GB | 280542 | A | | 12/1927 | |
| IT | 1050936 | B | | 3/1981 | |
| IT | BO20090576 | A1 | | 3/2011 | |
| JP | 57-28645 | A | * | 2/1982 | B21F 27/06 |
| RU | 158056 | U1 | | 12/2015 | |
| WO | 8002299 | A1 | | 10/1980 | |
| WO | 2004/069445 | A1 | * | 8/2004 | B21F 27/06 |
| WO | 2011030316 | A1 | | 3/2011 | |

OTHER PUBLICATIONS

Chinese Office Action with English Translation issued in corresponding Chinese Application No. 201780086018.X dated Jul. 10, 2020 (15 pages).
International Search Report issued in Application No. PCT/IB2017/050700 in English, dated Nov. 16, 2017 (3 pages).
Written Opinion of the International Searching Authority issued in Application No. PCT/IB2017/050700 in English, dated Nov. 16, 2017 (7 pages).
Notification of Transmittal of the International Preliminary Report on Patentability issued in Application No. PCT/IB2017/050700 in English, dated May 22, 2019 (1 page).
International Preliminary Report on Patentability issued in Application No. PCT/IB2017/050700 in English, dated May 22, 2019 (9 pages).
Italian Patent Office Search Report issued in corresponding Italian Application No. 10201700014176 dated Nov. 21, 2017 (11 pages).
Russian Federation Search Report with English translation, issued in corresponding Russian Application No. 2019128074 dated Mar. 13, 2020 (4 pages).
Chinese Office Action, with English translation, issued in corresponding Chinese Application No. 202110940047.6 dated Jan. 19, 2023 (15 pages).

* cited by examiner

MACHINE AND METHOD FOR MANUFACTURING A REINFORCED NET AND REINFORCED NET

TECHNICAL FIELD

The present invention relates to a machine and to a method for manufacturing a reinforced hexagonal net, and also to a reinforced hexagonal net.

BACKGROUND AND SUMMARY

The invention has been developed with particular regard, but not restrictively, to a machine for manufacturing a hexagonal-mesh net provided with at least one longitudinal reinforcing element, woven through the whole net and positioned so as to bisect the meshes through which it passes.

Over forty years ago (IT1050936), the present Applicant developed a machine for manufacturing a hexagonal net that provided at least one longitudinal reinforcing wire. The machine (FIG. 1) has proven to be very effective but is designed to be used with reinforcing wires 1 having the same thickness and strength as the wires 27 and 34 used for manufacturing the whole net. It is not, however, possible to use either high-strength wires, which are more rigid, or cables, which are more rigid and also thicker. In the machine, to allow the net to be woven with three wires into a twisted portion, a wire 34 is housed inside a cylindrical container 33 that can be wound around the other wires during weaving, as is common in the field. A device is provided for the reinforcing wire and the wire 27, which device allows the wire 27 to be rotated around a reel 85 over which the reinforcing wire 1 is wound. For this purpose, the reel 85 has compact dimensions and the wire 27 winds around it with a specially designed system. Clearly, a similar solution works perfectly with reinforcing wires 1 of a similar rigidity to the wires 27 and 34, but cannot be used with cables or high-strength wires, since it is impossible to wind them around a reel with such a small diameter. A spool of a suitable diameter for a cable or a high-strength wire would not, however, be compatible with this solution.

The applicant has also patented two hexagonal-mesh nets in which a wire is replaced by a cable. In these nets, each twisted portion comprises just two elements: either two wires or a wire and a cable. Consequently there is no provision for a device allowing a third wire/cable to be coiled together.

The object of the present invention is to solve the problems of the prior art and in particular to provide a machine for producing a hexagonal-mesh net having additional longitudinal reinforcing elements, wherein said reinforcing elements are high-strength wires or cables or ropes. A further object is that of producing an economic, safe piece of machinery that is reliable to use.

In order to achieve the above-mentioned objects, the present invention relates to a machine for manufacturing a reinforced net that has hexagonal meshes comprising a plurality of permanently deformable wires and at least one reinforcing element, the machine comprising a coiling mechanism for the reciprocal coiling of first wires and second wires in twos. The mechanism is provided with passages for the reinforcing elements, and a feed system for: the first wires, fed in from a plurality of containers that are mounted on board the machine and provided internally with a predetermined length of the first wires; part of the second wires, fed in alternately with the first wires so as to be interwoven therewith in twos in the coiling mechanism; and the reinforcing elements, fed into the machine, wherein, for all the reinforcing elements, a wire receptacle is provided for one of the second wires, the wire receptacle being rotatable around the reinforcing element. The invention also relates to a multiple-twist net having hexagonal meshes comprising a plurality of wires and at least one reinforcing element, the wires being coiled together in twos as primary twisted portions, wherein the two wires are coiled together, and secondary twisted portions. The wires are coiled together and around the reinforcing element, the reinforcing element having a greater strength than the strength of the wires.

BRIEF DESCRIPTION OF THE DRAWINGS

Further features and advantages will become evident from the following detailed description of a preferred embodiment of the invention, with reference to the attached drawings, provided purely by way of non-restrictive example, in which.

DETAILED DESCRIPTION

Figure 1:
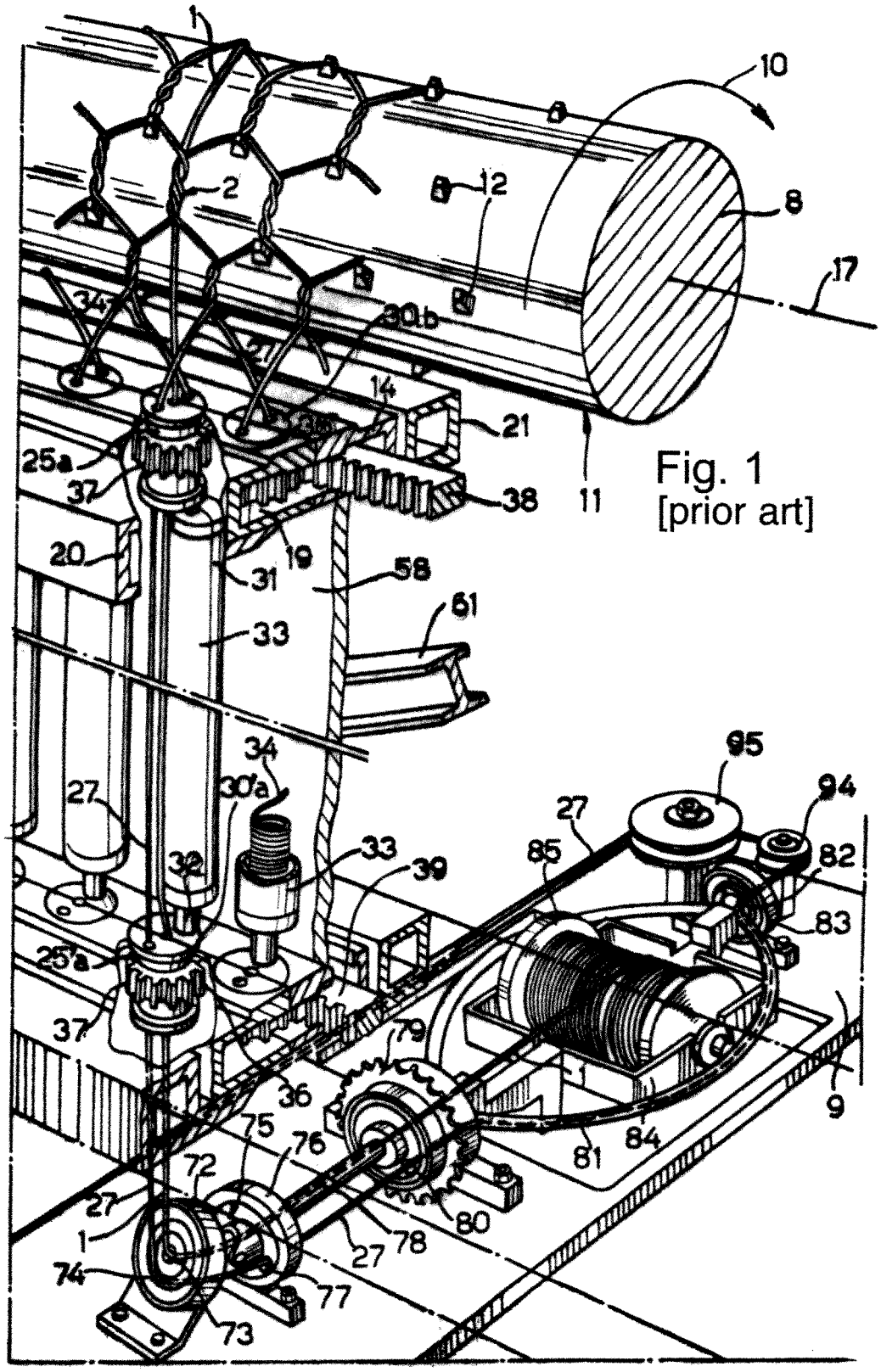
Fig. 1 [prior art]
FIG. 1 illustrates the machine according to the prior art.

In FIGS. 2-9, the same elements are indicated by the same reference numeral; the numbering is independent from that in FIG. 1, which is the prior art.

Figure 3:
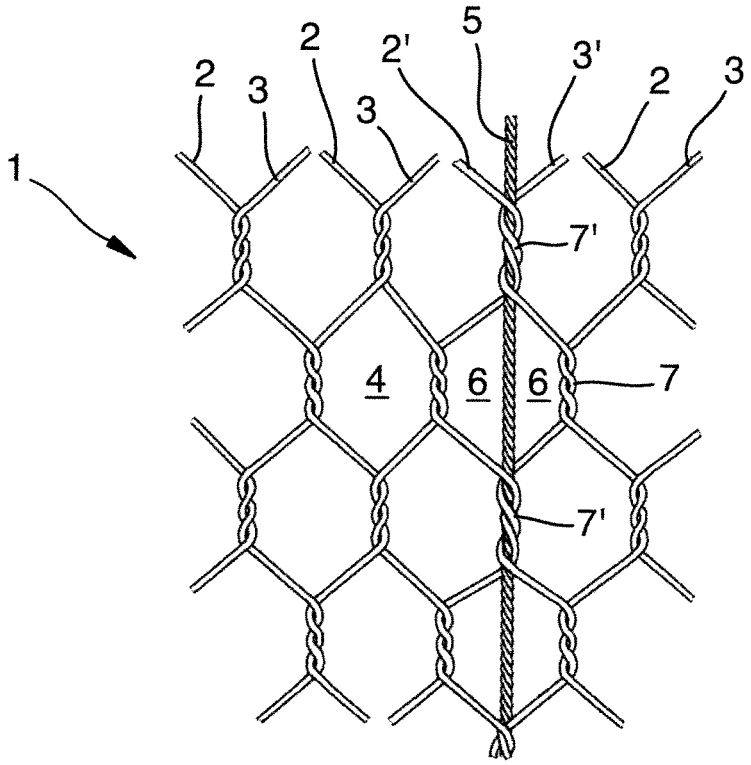
FIG. 3 shows a net produced by the machine in FIG. 2.

The portion of net 1 in FIG. 3 is a double-twist net comprising hexagonal meshes and reinforcing cables. It comprises a plurality of wires 2, 3, 2', 3' coiled around one another in twisted portions 7, 7', to form hexagonal meshes 4, and at least one reinforcing cable 5 inserted longitudinally through selected twisted portions 7'. Between two successive twisted portions 7' in the longitudinal direction, the reinforcing cable forms two trapezoidal meshes 6 placed side by side. Here and below, the term "cable" will be used for conciseness; it is, however, understood that any reinforcing element having a strength greater than the strength of the wires making up the net can be used. For example, it can be a metal cable made up of several strands, a rope having a textile core or else a high-strength metal wire, and can be galvanised or plastics-coated if appropriate.

The wires and cables making up the net are all arranged in the same direction, which will be denoted below as being longitudinal. Each wire 2, 3 is coiled alternately with the preceding wire 3, 2 and the subsequent wire 3, 2, as known in a double-twist net, to form the twisted portions 7.

Furthermore, for all cables 5, a wire 2' is coiled alternately with the single preceding wire 3, forming a twisted portion 7, and with a subsequent wire 3' together with the reinforcing cable 5, forming a twisted portion 7' having three elements.

Similarly, the wire 3' is coiled alternately with the preceding wire 2', together with the reinforcing cable 5, forming a twisted portion 7' having three elements, and with the single subsequent wire 2, forming a twisted portion 7 having just two elements.

Twisting follows the same twist direction in each twisted portion 7, 7': clockwise or anticlockwise but constant in each twisted portion. In FIG. 3 the twisted portions 7, 7' have the wires 2, 3 coiled in directions that alternate from one row to the next: if in one row the wires 2 and 3 are coiled together in a clockwise direction, in the row below and the one above the wires 2 and 3 are coiled in an anticlockwise direction. A variant wherein all the twisted portions 7, 7' have the same direction of weaving should not, however, be ruled out.

Figure 4:
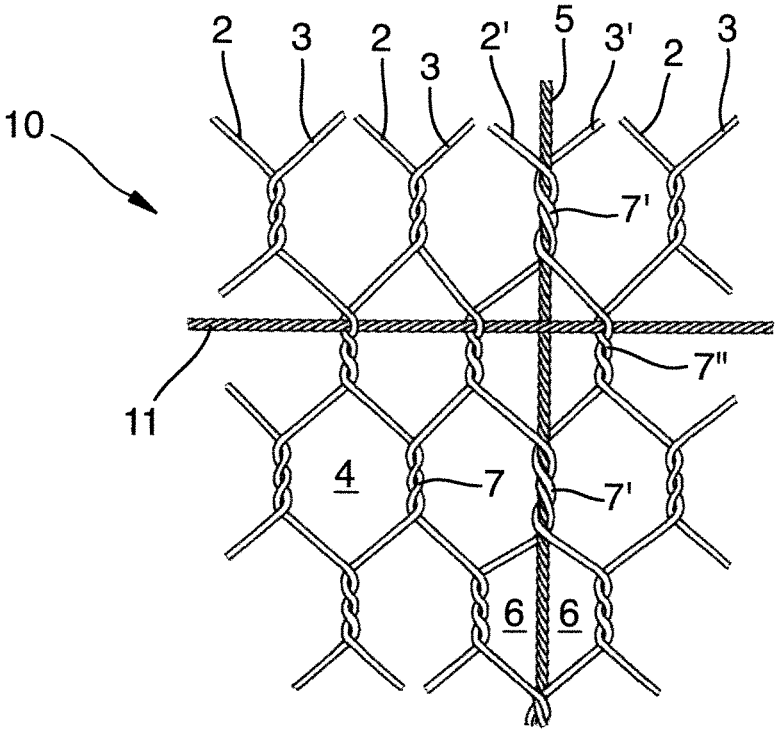
FIG. 4 shows another net produced by the machine in FIG. 2.

In the variant in FIG. 4, the net 10 further comprises at least one transverse cable 11. The cable 11 is positioned perpendicularly to the cables 5, which cable 11 intersects the cables 5 at intersections 12, and is inserted into twisted portions 7" formed by two single longitudinal wires 2, 3, 2', 3'.

It should be noted that the portions of net depicted in FIGS. 3 and 4 show a single longitudinal cable 5 and a single transverse cable 11 because the portion depicted is small, so as to be able to consider it in detail. Nonetheless, a plurality of longitudinal and transverse cables are normally provided. A net having these characteristics has extremely high resistance to puncture and traction, given by the reinforcing cables that directly bear most of the stress; in traditional double-twist nets it is, however, the wires that have to bear the stress.

Preferably, the cables 5, 11 are less than a meter away from each other both transversely (for both embodiments) and longitudinally (for the embodiment in FIG. 4), so as to ensure adequate strength. It should be noted, for example, that regulations for puncture tests provide for the use of a square punch with a 1 m side; hence the presence of cables at a distance of less than one meter ensures that at least one longitudinal cable and one transverse one (if present) are in line with the punch.

The function of the wires in the net in question is to hold the small material and above all to keep all the cables in a fixed position, which cables are directly interwoven in the twisted portions, and to hold fast the intersection points 12 between cables 5, 11.

The machine according to the invention, intended for producing a net having the features described above, is in part similar to a known machine for the assembly of traditional double-twist nets, developed many years ago by the same applicant. In the following description, which while relating to the whole machine, will focus mostly here on the new and original elements that make it possible to produce a net having the reinforcing cables 5 and, preferably, 11.

Figure 2:
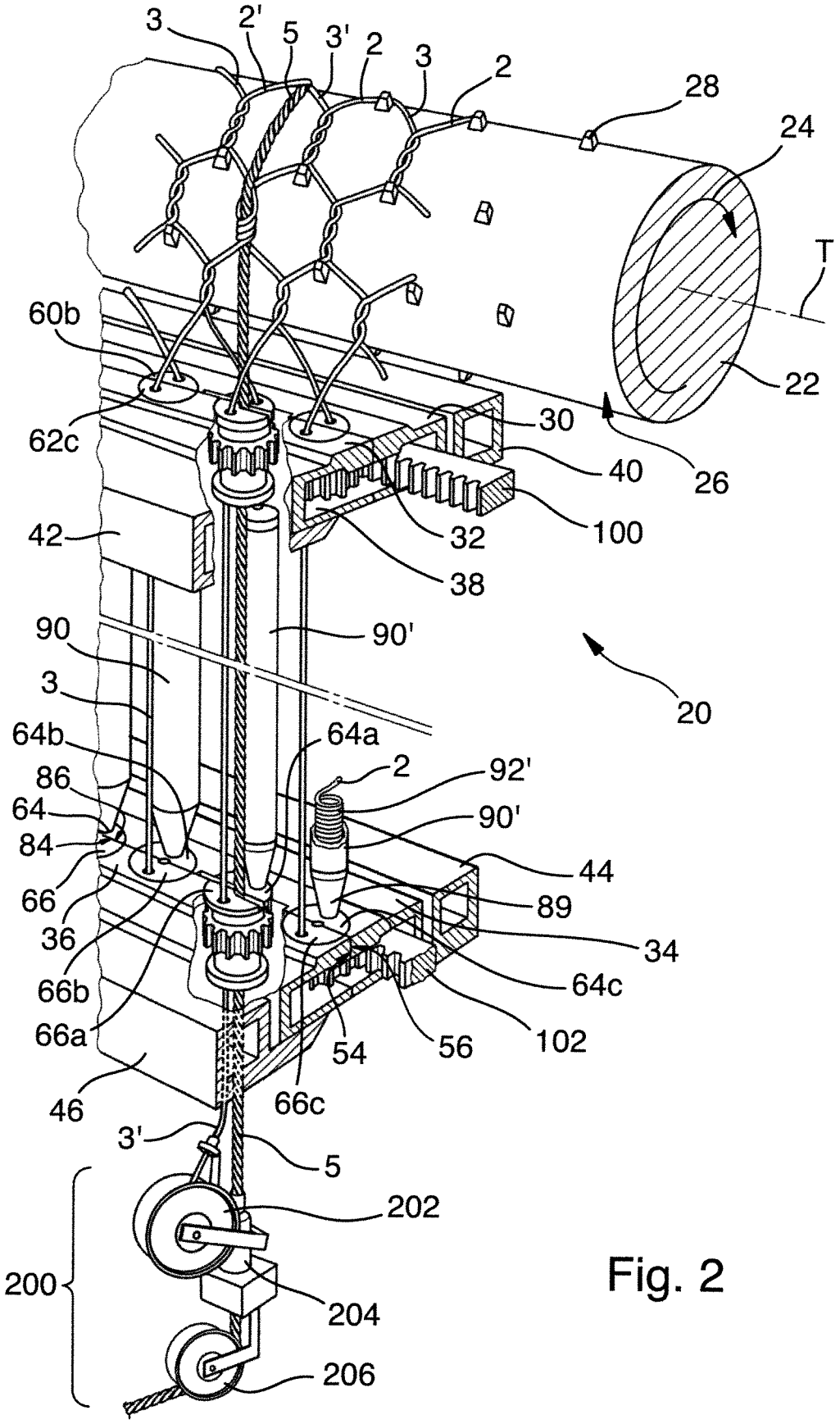
FIG. 2 shows a portion of a machine according to the invention.

As can be seen in FIG. 2, the machine 20 comprises a drum 22, mounted with means (not illustrated) in the fixed framework of the machine so that it can rotate at a constant speed in the direction of the arrow 24 about its axis T. Radial protuberances or pegs 28 project outwards from the curved face 26 of the drum. These pegs are arranged in rows that extend in a direction parallel to the axis T and are arranged at equal angular intervals. The pegs 28 are positioned at a constant spacing within each row and two successive rows are out of phase with each other by a half-pitch in the axial direction.

These pegs serve to form the hexagonal-mesh net and to hold a portion of the net already formed in the outlet direction of the machine.

Below the drum 22, two pairs of bars 30, 32 and 34, 36 are provided, which are parallel to the axis T and support semi-cylindrical rotatable bodies 60, 62, 64 and 66; the function of the semi-cylindrical bodies is to coil the wires together in pairs, to produce the net.

The bars have a U-shaped cross section. They are positioned in pairs with the respective open edges of the U facing one another and lying in a vertical plane of symmetry that is tangent to the periphery of the drum 22; the bars 30 and 32 form an upper pair and the bars 34 and 36 form a lower pair. Naturally, upper and lower indicate the position in which the bars are arranged in the embodiment in the figures. Positioning them in a different way, for example with the wires running horizontally, is by no means ruled out, however. More generally, an "upper" bar is downstream in the working direction compared with a corresponding "lower" bar, irrespective of the height at which it is placed.

The bars are supported by elements 40, 42, 44, 46, which form part of the fixed framework of the machine. They can also move in a direction parallel to that of the axis T.

Figure 6:
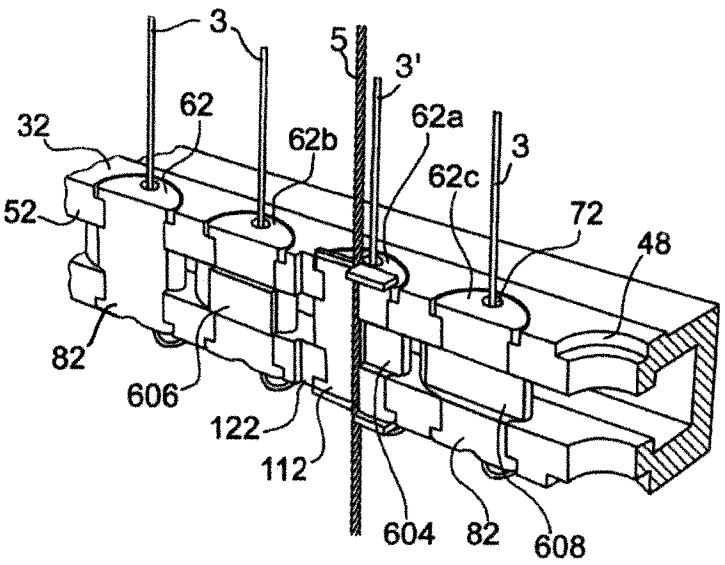
FIG. 6 is a detailed view of an upper bar 32 of the machine in FIG. 2.
Figure 5:
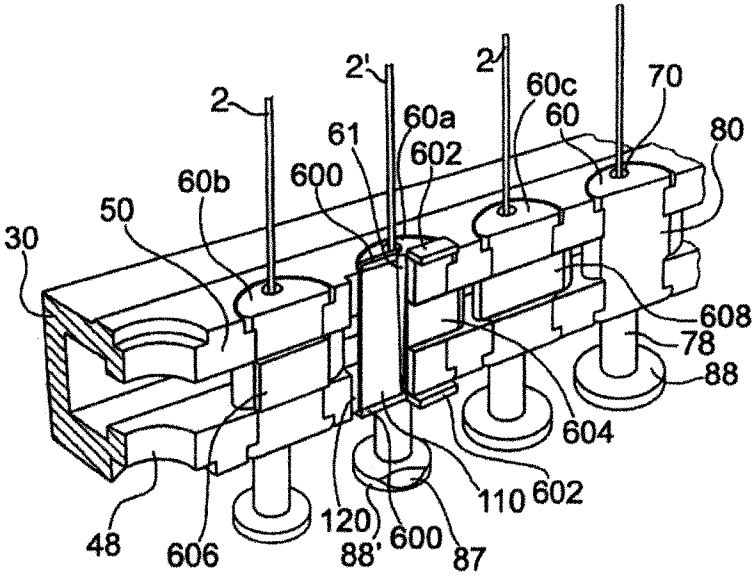
FIG. 5 is a detailed view of an upper bar 30 of the machine in FIG. 2.

FIGS. 5 and 6 depict in greater detail the bars 30 and 32, which are exactly the same as the bars 34 and 36 of the lower pair of bars. A plurality of through-seatings 48 are made in the edges 50, 52, 54, 56 of each of the bars 30, 32, 34, 36 of all the pairs facing the respective edges 52, 50, 56, 54 of the paired bar. The through-seatings 48 are semi-cylindrical, having axes perpendicular to the axis T and lying in the above-mentioned plane of symmetry; the distance between each seating and the adjacent seating in the same bar is equal to the distance between the pegs 28. Each of said seatings 48 faces a similar seating 48 made in the edges of the other bar of the same pair.

A semi-cylindrical rotatable body 62, 66 is mounted in each of the seatings 48 in the bars 32, 36. The rotatable bodies 62 of the upper bar 32 are aligned with the rotatable bodies 66 of the lower bar 36 and have through-holes 72, 76 having axes parallel to the axes of the semi-cylindrical rotatable bodies which are aligned with each other within the superimposed semi-cylindrical bodies 62, 66. Wires 3, 3' pass through these holes and are fed into the net being formed, as described more clearly below.

The semi-cylindrical bodies 62, 66 have diametrical plane faces 82, 86, which normally lie in the above-mentioned plane of symmetry. These plane faces 82, 86 are juxtaposed with corresponding plane faces 80, 84 of corresponding semi-cylindrical bodies 60, 64 housed in the seatings 48 made in the bars 30, 34.

Each semi-cylindrical body 60 carried by the bar 30 has an eccentric axial pivot 78 protruding downwards and on which a plate 88 engages, which plate is preferably discoid and coaxial with the pivot 78. The pivot 78 and the plate 88 are aligned with a corresponding conical element 89 placed eccentrically on the corresponding semi-cylindrical body 64, protruding upwards. Each pair formed by a plate 88 and a conical element 89 allows a cylindrical container 90, 90' containing a predetermined length of wire 2, wound in a coil 92, 92', to be mounted. The wires 2, 2' emerge upwards from the containers 90, 90', pass through the through-holes 70 and are fed into the machine for forming the net, together with the wires 3, 3'. In use, the cylindrical containers 90, 90' rotate around the wires 3, 3', so as to prevent the twisting of the wires 2 and 3 above the semi-cylindrical bodies 60, 62 from creating an equal and opposite twist therebelow.

It should be noted that, for all the cables 5, two cylindrical containers 90' are provided, which are narrower than the other containers 90. During operation, these two containers are in turn actually located close to the cable 5 and if kept at normal dimensions would press too much against the cable 5. For the same reason, the two containers 90' are mounted on plates 88', which are also narrower; furthermore, one of these has a bevel 87 to prevent the reinforcing element 5 from pressing against a sharp edge while the net is being woven.

The pairs of bars 30, 32 and 34, 36 are connected by racks to positioning mechanisms that allow the two superimposed bars 32, 36 and the two superimposed bars 30, 34 to be moved simultaneously in a direction parallel to the axis T of the drum, but in opposite directions. The positioning mechanisms are configured such that each semi-cylindrical body carried by a bar can be moved from one position, in which it faces a first semi-cylindrical body of the paired bar, into a second position, in which it faces a second semi-cylindrical body that is adjacent to the first semi-cylindrical body. Furthermore, the semi-cylindrical rotatable bodies are connected, by racks like those 100, 102 visible in FIG. 2, to rotation mechanisms that set them in rotation in pairs, in order to interweave a wire 2 and a wire 3 and create a twisted portion and, thus, the net.

In the known machines for producing simple double-twist nets, with no reinforcing elements, all the semi-cylindrical bodies 62, 66 and 60, 64 are identical to one another. In the machine according to the present invention, however, some groups of semi-cylindrical bodies have small but significant structural differences. In particular, for each cable 5 there are provided three pairs of modified semi-cylindrical bodies 60*a* and 62*a*, 60*b* and 62*b*, 60*c* and 62*c* housed in the upper bars 30 and 32 and an equal number of modified semi-cylindrical bodies 64*a* and 66*a*, 64*b* and 66*b*, 64*c* and 66*c* housed in the lower bars 34 and 36.

The cable 5 must in fact also be fed into the machine, but does not need to be moved laterally while the net is being woven, since it always maintains a straight course.

Figure 7:
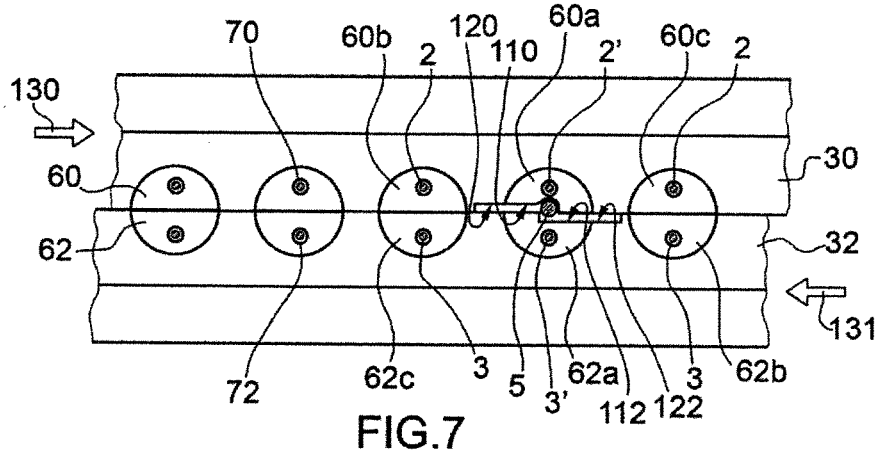
FIG. 7 shows the pair of upper bars 30 and 32 in a first position.

Consequently, it is fed in a fixed position, corresponding to the common axis of rotation of two semi-cylindrical bodies 62*a*, 60*a* and 66*a*, 64*a* in the first operating position of FIG. 7.

To allow the cable 5 to stay still while the semi-cylindrical bodies 62*a*, 60*a* and 66*a*, 64*a* are moved as described above, into the positions depicted in FIGS. 8 and 9, the semi-cylindrical bodies 62*a*, 60*a* and 66*a*, 64*a* each have a groove 112, 110 and 116, 114, respectively. Each groove 112, 110, 116, 114 in the semi-cylindrical bodies 62*a*, 60*a*, 66*a*, 64*a* continues over the edge 52, 50, 56, 54, respectively, of each of the bars 32, 30, 36, 34 in a groove 122, 120, 126, 124. The grooves in the semi-cylindrical bodies and in the edges of the bars have the same depth, slightly greater than the radius of the cable 5, so that two grooves facing one another can comfortably house the cable 5 without compressing it. Widthways, each groove in the semi-cylindrical body is equal to at least the radius of the semi-cylindrical body plus the radius of the cable 5. Each groove created by the combination of the groove in the semi-cylindrical body and the groove on the edge of the bars is at least as wide as the pitch between two pegs 28, plus the diameter of the cable 5.

Figure 8:
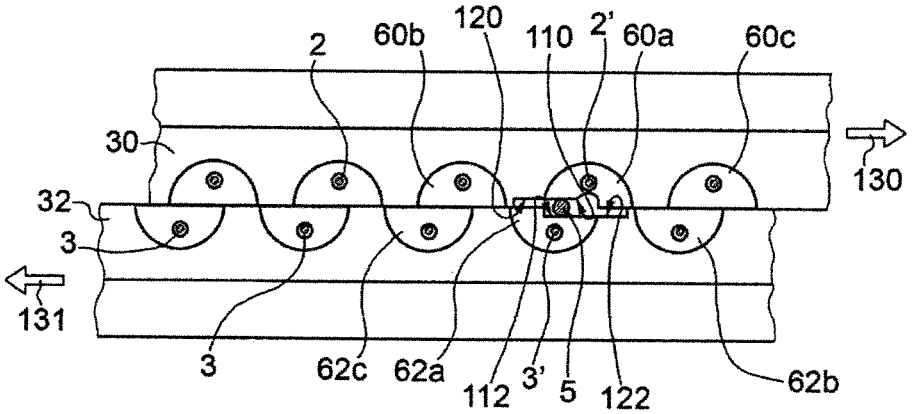
FIG. 8 shows the pair of upper bars 30 and 32 in a second position.
Figure 9:
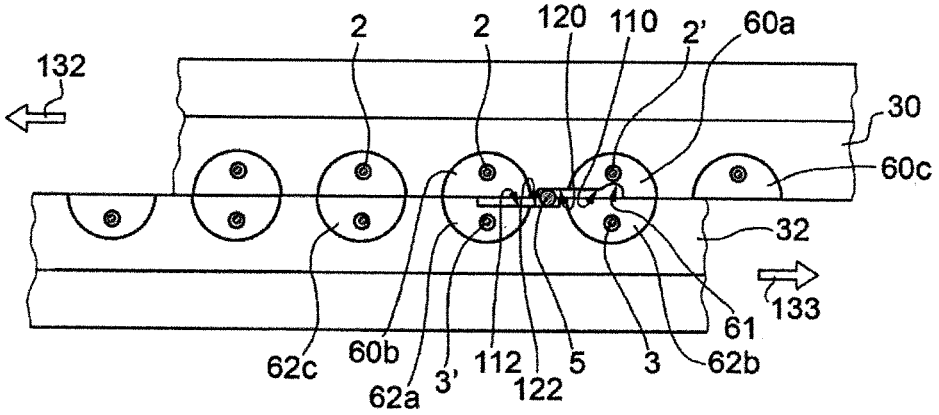
FIG. 9 shows the pair of upper bars 30 and 32 in a third position.

Thanks to these grooves, when the semi-cylindrical bodies 62*a*, 60*a*, 66*a*, 64*a* are moved to the positions depicted in FIGS. 8 and 9, the cable 5 runs within the grooves facing one another, staying substantially still.

Furthermore, to prevent the cable 5 from rubbing excessively against the cylindrical containers 90', the semi-cylindrical bodies 62*a*, 60*a*, 66*a*, 64*a* have a slanting channel, visible in the figures only for the semi-cylindrical body 60*a*, where it is indicated with the numeral 61. The channel 61 (and the corresponding channel provided in the body 62*a*, slanting in the same direction) allows the cable 5 to have a slightly slanted arrangement when the semi-cylindrical bodies are in the position in FIG. 7, so as to reduce pressure and rubbing against the cylindrical container 90' and the plate 88'. The semi-cylindrical bodies 66*a*, 64*a* also have a similar slanting channel, slanted in the opposite direction to that of the semi-cylindrical bodies 62*a*, 60*a*, for the same reason.

To keep the cable still when the semi-cylindrical bodies 60*a* and 62*a*, 64*a* and 66*a* are facing, protrusions 600 and 602 are provided on each semi-cylindrical body 60*a*, 62*a*, 64*a* and 66*a*. These protrusions project from the upper and lower faces of each semi-cylindrical body. Furthermore, the protrusions 600 have a face that is coplanar with the groove 110, 112, 114, 116. The protrusions 602, on the other hand, project from the diametral plane face 80, 82, 84, 86 so that they abut against the protrusions 600 when the semi-cylindrical bodies 60*a* and 62*a*, 64*a* and 66*a* are facing each other. In this way, when the semi-cylindrical bodies 60*a* and 62*a*, 64*a* and 66*a* are facing each other, the cable 5 remains embraced between the protrusions 602. Furthermore, the two semi-cylindrical bodies facing one another always remain completely coupled, being in contact with each other by means of the protrusions 600 and 602 along their whole diameter, with the sole exception of the passage for the cable 5.

During manufacture, the semi-cylindrical body 60*a* is in turn facing the body 62*a* in a first position (FIG. 7) and the body 62*b* in a second position (FIG. 9). Similarly, the semi-cylindrical body 62*a* is in turn facing the body 60*a* in the first position (FIG. 7) and the body 60*b* in the second position (FIG. 9). The bodies 60*a* and 62*a* have a channel 604 in the diametral plane face 80, 82, of the same depth as the groove 110, 112. On the other hand, a protuberance 606 of the same depth and height is provided on the diametral plane face 80, 82 of the bodies 60*b*, 62*b*. This protuberance 606 is therefore in contact with the groove 110, 112 and the channel 604, when the semi-cylindrical bodies are in the second position in FIG. 9. In this way, in the second position, the semi-cylindrical bodies of the pairs 60*a* and 62*b*, 60*b* and 62*a* are in contact with each other along their whole diameter, for stable coupling.

Finally, the semi-cylindrical bodies 60*c* and 62*c* have a channel 608, having the same depth and height as the protuberance 606 and a width equal to the whole width of the semi-cylindrical body. This channel 608 allows the semi-cylindrical bodies 60*b*, 62*b* to be coupled to the semi-cylindrical bodies 62*c* and 60*c*, respectively, in the first position in FIG. 7.

Naturally, the same system of protuberances and channels is also present in the semi-cylindrical bodies 64*a*, 64*b*, 64*c* and 66*a*, 66*b*, 66*c*, corresponding to the description given above of the semi-cylindrical bodies 60*a*, 60*b*, 60*c* and 62*a*, 62*b*, 62*c*.

With reference now, in greater detail, to FIG. 7-9, it should be noted that in these drawings the protrusions 600 and 602 are not depicted because they would hinder understanding of the operation illustrated in the figures.

In use, the upper bars 30, 32 are first positioned so that the semi-cylindrical bodies 60, 60*a*, 60*b*, 60*c* are directly facing the semi-cylindrical bodies 62, 62*a*, 62*b*, 62*c*, respectively (FIG. 7). Wires 2 and 2' are inserted into the holes 70, wires 3 and 3' are inserted into the holes 72 and a cable 5 is housed between the grooves 110 and 112 in the two semi-cylindrical bodies 60*a* and 62*a*.

In this position, two rotations of the pairs of semi-cylindrical bodies determine the formation of the twisted portions 7; the rotation of the semi-cylindrical bodies 60*a* and 62*a* determines the formation of the twisted portion 7', which comprises both two wires 2' and 3', and the cable 5. It should be noted that all the movements of the upper bars 30, 32 and the semi-cylindrical bodies positioned therein are also carried out in an identical fashion by the lower bars 34, 36 and by the semi-cylindrical bodies positioned therein, both in this and in all phases of production.

Once the two twists are completed, the two bars 30, 32 are moved in the direction of the arrows 130, 131, passing through the position in FIG. 8 and reaching the position in FIG. 9. In this position, the semi-cylindrical body 60*a* is facing a semi-cylindrical body 62*b* and the semi-cylindrical body 62*a* is facing a semi-cylindrical body 60*b*. In this position, two rotations of the semi-cylindrical bodies, preferably in the opposite direction to that taken in the phase in FIG. 7 (in other words, if the twists in FIG. 7 took place clockwise, in FIG. 9 they take place anticlockwise and vice versa), determine the formation solely of twisted portions 7, which comprise just two wires 2 or 2' and 3 or 3'. The cable 5, on the other hand, is housed between the two grooves 120 and 122 provided in the two bars 30, 32 and is therefore not involved in the twisting but is located between two adjacent twists 7.

Finally, the two bars 30, 32 are again moved in the directions of the arrows 132 and 133, which are respectively opposite the directions 130, 131 taken in the previous movement. The position in FIG. 7 is thus returned to and weaving of the net continues.

In a machine for manufacturing a hexagonal-mesh net of a traditional type, the wires 3 are fed into the semi-cylindrical bodies 66 from spools, reels or the like, positioned on the rear of the machine; the moveable containers 90, 90' rotating around the wires 3.

In the machine according to the present invention, to allow the insertion of cables 5, a device for feeding in a wire 3', given the overall numeral 200, is provided for each cable 5. The device comprises a reel 202 around which the wire 3' is wound, which reel is rotatable about both its axis, in order to reel out the wire, and around a support 204 (fastened directly to the framework of the machine). The cable 5 runs through the support 204, so that the reel 202 can rotate around the support 204 and therefore around the cable 5 while the net is being woven. After the cable 5 is diverted through a snub pulley 206, it can therefore be fed directly from a spool or in some other way if desired, without any constraint.

Thanks to the feeding device 200 it is possible to use a cable having any desired diameter, which could not be housed in a reel like that of the prior art. Similarly, it is possible to use a high-strength reinforcing wire which, being more rigid than the wires 2, 3 (normally made of mild steel), could not be housed in the known reel unless a device for straightening the wire were also provided, although this would have provided a mediocre result.

In particular, the applicant has found that with wires, cables or ropes having a strength greater than approximately 500 or 600 kg/mm$^2$, it is impossible to use the known machine and therefore the machine forming the subject matter of the present invention is particularly beneficial. It is stressed that the new machine may nonetheless also be used with reinforcing wires 1 of a lesser strength, even identical to the wires 2 and 3 that make up the hexagonal meshes, to produce a reinforced net of a known type.

Preferably, the reinforcing elements 1 have a diameter of between 4 and 10 mm and even more preferably between 5 and 8 mm. The wires 2, 3, 2', 3', on the other hand, have a diameter of between 1.8 and 3.9 mm and can also be galvanised or plastics-coated. The hexagonal meshes 4 of the net preferably have the dimensions 5×7, 6×8, 8×10, 10×12 or 12×14 mm.

For simplicity, the portion of the machine depicted and described provides for the use of a single cable 5, but it should be noted that it is possible and even recommended to insert more cables 5 into the same net. For each cable 5, all the contrivances described above can be provided: a pair of cylindrical containers 90' having a reduced diameter, modified semi-cylindrical bodies 60*a*, 60*b*, 60*c*, 62*a*, 62*b*, 62*c*, 64*a*, 64*b*, 64*c*, 66*a*, 66*b* and 66*c*, as well as, and in particular, a feed device 200.

The preferred distance between two adjacent cables 5 is between 25 cm and 100 cm. The overall lateral dimension of the net is preferably between 2 and 5 m.

The machine described above can also be used for producing a net that also has transverse cables 11 like that described above with reference to FIG. 4. It is in fact enough, during the weaving of the net, to insert cables 11 periodically, immediately above the semi-cylindrical bodies 60, 62 during weaving. For greater success, it is advisable to insert the cables 11 into different twisted portions 7" from the twisted portions 7' formed by two wires 2, 3 and a cable 5. The cable 11 should therefore preferably be inserted when the semi-cylindrical bodies 60, 62 are in the position depicted in FIG. 9, after they have completed a first rotation and before they complete the second one.

The preferred distance between two adjacent transverse cables 11 is between 25 cm and 100 cm.

Naturally, without prejudice to the principle of the invention, the embodiments and the implementation details can vary greatly from what is described and illustrated, while remaining within the scope of the invention.

The invention claimed is:

1. A machine for manufacturing a reinforced net that has hexagonal meshes comprising a plurality of permanently deformable wires and at least one reinforcing element, the machine comprising a mechanism for the reciprocal coiling of first wires and second wires in twos, which mechanism is provided with passages for the reinforcing elements, and a feed system for:

the first wires, fed in from a plurality of containers that are mounted on board the machine and provided internally with a predetermined length of said first wires, part of the second wires, fed in alternately with the first wires so as to be interwoven therewith in twos in the coiling mechanism, and the reinforcing elements, fed into the machine, wherein, for each reinforcing element, a reel is provided for feeding one of the remaining said second wires, the reel being rotatable around the reinforcing element.

2. The machine according to claim 1, wherein, for each reinforcing element, two of the plurality of containers for feeding in the first wires that are closer, in use, to the reinforcing element are narrower than the others of the plurality of containers.

3. The machine according to claim 1, wherein the reciprocal coiling mechanism comprises:

an upper pair of supports for rotatable semi-cylindrical bodies, the rotatable semi-cylindrical bodies each being provided with a through-hole through which a first or a second wire passes and being capable of being coupled in twos and rotatable in pairs, so as to form twisted portions of the net, at least one pair of said rotatable semi-cylindrical bodies further being provided with a groove to accommodate the reinforcing element while the wires are being coiled together or around said reinforcing element, a lower pair of supports for rotatable semi-cylindrical bodies, the lower pair of supports and their semi-cylindrical bodies being in direct correspondence with the upper pair of supports and their related semi-cylindrical bodies and being moveable synchronously therewith, at least one pair of said rotatable semi-cylindrical bodies associated with the lower pair of supports furthermore being provided with a groove to accommodate the reinforcing element, and wherein a plurality of wires are slidable between the semi-cylindrical bodies of one support of the lower pair of supports and the corresponding semi-cylindrical bodies of the corresponding support of the upper pair of supports.

4. The machine according to claim 3, wherein the supports for the semi-cylindrical bodies are bars that have a U-shaped cross-section and are positioned in pairs with the respective open edges of the U facing one another, the bars lying in a vertical plane of symmetry and being moveable in the direction of their length, a plurality of through-seatings being made in the edges of each of the bars of each pair facing the respective edges of the paired bar, each through-seating facing a similar seating made in the edges of the other bar of the same pair for the semi-cylindrical bodies, wherein each groove in the semi-cylindrical bodies continues respectively over the edge of each of the bars into another groove and wherein the grooves in the semi-cylindrical bodies and the grooves in the edges of the bars have a depth slightly greater than a radius of the reinforcing element and an overall width that is equal to a width of a mesh of the net, plus a diameter of the reinforcing element.

5. The machine according to claim 1, wherein the reel has an axis of rotation and rotates about the axis of rotation to unwind the remaining one of the second wires therefrom and feed the remaining one of the second wires to the reciprocal coiling mechanism, the reel in its entirety being additionally rotatable around the reinforcing element.

6. The machine according to claim 5, wherein the machine further comprises a frame and the feed system further comprises a support element attached to the frame, the reinforcing element being supported on the support element and the reel being mounted on the support element such that the reel in its entirety rotates around the reinforcing element.

7. The machine according to claim 1, wherein each of the reels is disposed adjacent the corresponding reinforcing element and the remaining one of the second wires is wound around the reel such that the reel feeds the remaining one of the second wires to the reciprocal coiling mechanism, each of the reels being mounted for rotation about the corresponding reinforcing element.

8. The machine according to claim 1, wherein each of the reels in its entirety is rotatable around the corresponding reinforcing element.

9. A machine for manufacturing a reinforced net with hexagonal meshes incorporating a plurality of wires and at least one reinforcing element, said machine comprising:

a coiling arrangement including rotatable bodies configured to coil first wires and second wires in twos, and a passage for the at least one reinforcing element;

a feed system, said feed system comprising:

a plurality of containers mounted on-board said machine for feeding the first wires to said coiling arrangement, said plurality of containers being provided internally with a predetermined length of the first wires, said feed system being configured to feed in some of the second wires alternately with the first wires such that the second wires are interwoven therewith in twos in said coiling arrangement; and a reel corresponding to the at least one reinforcing element, said reel being disposed to feed one of the remaining second wires to said coiling arrangement and being rotatable around the at least one reinforcing element.

10. The machine according to claim 9, wherein said reel has a rotational axis and rotates about the rotational axis to unwind the remaining one of the second wires therefrom and feed the remaining one of the second wires to said coiling arrangement, said reel being additionally rotatable around the at least one reinforcing element.

11. The machine according to claim 10, wherein said feed system further comprises a support element attached to a frame of said machine, the at least one reinforcing element being supported on said support element and said reel being supported on said support element such that said reel in its entirety rotates about the at least one reinforcing element.

12. The machine according to claim 9, wherein said reel is disposed adjacent the at least one reinforcing element and has the remaining one of the second wires wound therearound, the reel being mounted for rotation around the at least one reinforcing element.

13. The machine according to claim 9, wherein said reel in its entirety is rotatable around the at least one reinforcing element.

* * * * *